US012173936B2

(12) United States Patent
Kanagala et al.

(10) Patent No.: US 12,173,936 B2
(45) Date of Patent: Dec. 24, 2024

(54) INTERLACED MICROCHANNEL HEAT EXCHANGER SYSTEMS AND METHODS THERETO

(71) Applicant: Rheem Manufacturing Company, Atlanta, GA (US)

(72) Inventors: Hari Krishna Kanagala, Fort Smith, AR (US); Harold Gene Havard, Jr., Fort Smith, AR (US); Robert Leonard Long, Fort Smith, AR (US); Rosa Leal, Dallas, TX (US); David Kauppila, Fort Smith, AR (US); Junjie Luo, Fort Smith, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 18/492,634

(22) Filed: Oct. 23, 2023

(65) Prior Publication Data

US 2024/0053068 A1 Feb. 15, 2024

Related U.S. Application Data

(63) Continuation of application No. 17/573,267, filed on Jan. 11, 2022, now Pat. No. 11,828,499.

(Continued)

(51) Int. Cl.

*F25B 39/00* (2006.01)
*F25B 13/00* (2006.01)

(Continued)

(52) U.S. Cl.

CPC ..... *F25B 39/00* (2013.01); *F25B 13/00* (2013.01); *F25B 39/028* (2013.01); *F25B 39/04* (2013.01);

(Continued)

(58) Field of Classification Search

CPC ..... F25B 39/00; F25B 13/00; F25B 39/028; F25B 39/04; F25B 2339/041;

(Continued)

(56) References Cited

U.S. PATENT DOCUMENTS 10,830,514 B2 * 11/2020 Bachellor ..... F25B 6/04
2005/0155375 A1 7/2005 Wensink et al.

(Continued)

FOREIGN PATENT DOCUMENTS

CN 103644685 A 3/2014
WO 2023030508 A1 9/2023

OTHER PUBLICATIONS

PCT, "International Search Report & Written Opinion" Application No. PCT/US2022/011962, dated Jul. 6, 2022 (6 pp.).

*Primary Examiner* — Henry T Crenshaw
*Assistant Examiner* — Kamran Tavakoldavani
(74) *Attorney, Agent, or Firm* — Eversheds Sutherland (US) LLP

(57) ABSTRACT

The disclosed technology includes an air system including a first interlaced microchannel heat exchanger and a second interlaced microchannel heat exchanger. The air system can include a plurality of fluidly separated refrigerant circuits, and each of the refrigerant circuits can be configured to flow through the first interlaced microchannel heat exchanger and the second interlaced microchannel heat exchanger. The first interlaced microchannel heat exchanger can be located indoors, and the second interlaced microchannel heat exchanger can be located outdoors. Each of the refrigerant circuits can include its own compressor and expansion valve.

19 Claims, 12 Drawing Sheets

Related U.S. Application Data

(60) Provisional application No. 63/136,440, filed on Jan. 12, 2021.

(51) Int. Cl.
*F25B 39/02* (2006.01)
*F25B 39/04* (2006.01)

(52) U.S. Cl.
CPC ..... *F25B 2339/041* (2013.01); *F25B 2400/06* (2013.01)

(58) Field of Classification Search
CPC .. F25B 2400/06; F25B 39/02; F25B 2339/02; F25B 25/005; F25B 2400/061; F25B 41/26; F25B 2313/0292
See application file for complete search history.

(56) References Cited

U.S. PATENT DOCUMENTS

| | | | | |
|---|---|---|---|---|
| 2006/0123819 | A1* | 6/2006 | Choe | F25B 27/02 62/323.3 |
| 2010/0326099 | A1* | 12/2010 | Maxwell | F24D 3/10 62/115 |
| 2011/0203299 | A1 | 8/2011 | Jing et al. | |
| 2016/0084539 | A1* | 3/2016 | Schutte | F25B 40/02 62/498 |
| 2018/0299171 | A1 | 10/2018 | Olsen et al. | |
| 2019/0257594 | A1* | 8/2019 | Inoue | F28F 9/0263 |
| 2019/0331380 | A1 | 10/2019 | Seiler et al. | |
| 2019/0368817 | A1 | 12/2019 | Huang et al. | |
| 2023/0358486 | A1 | 11/2023 | Xiao et al. | |

* cited by examiner

INTERLACED MICROCHANNEL HEAT EXCHANGER SYSTEMS AND METHODS THERETO

CROSS-REFERENCE TO RELATED APPLICATIONS

This application is a continuation of U.S. application Ser. No. 17/573,267, filed Jan. 11, 2022, which claims the benefit of U.S. Application No. 63/136,440, filed Jan. 12, 2021, the entire contents and substance of both are incorporated herein by reference as if fully set forth below.

FIELD OF DISCLOSURE

The present disclosure relates generally to heat exchanger systems and methods and, in particular, to heat exchanger systems and methods that include multiple interlaced microchannel heat exchangers (iMCHXs) (e.g., a first iMCHX configured to function as an evaporator and a second iMCHX configured to function as a condenser).

BACKGROUND

Commercial buildings, homes, or other structures can commonly be equipped with one or more air systems for heating and/or cooling, such as a heat pump system or an air conditioner system. These air systems can include an indoor unit and an outdoor unit in fluid communication via a refrigerant circuit. For example, referring to FIG. 1, air conditioner systems can include a refrigerant circuit that includes a compressor, a condenser, an expansion valve, and an evaporator, which can operate to provide a cooling effect in an indoor space by transferring heat from the indoor space to the refrigerant via the evaporator and transferring heat from the refrigerant to an outdoor space via the condenser. As another example, heat pump systems can include a refrigerant circuit similar to the one shown in FIG. 1 but also including a reversing valve or another component or system configured to selectively change the direction of refrigerant flow through the refrigerant circuit. Thus, the heat pump system can have a cooling mode in which the indoor heat exchanger operates as an evaporator and the outdoor unit operates as a condenser (i.e., operating as an air conditioner system), and the heat pump system can have a heating mode in which the indoor heat exchanger operators as a condenser and the outdoor heat exchanger operates as an evaporator (i.e., operating as a heating system).

To improve the efficiency and performance of air systems, the microchannel heat exchanger was designed. Referring to the partial cross-sectional view shown in FIG. 2, microchannel heat exchangers are heat exchangers that direct the flow of refrigerant through ports that are smaller in internal diameter than conventional finned heat exchanger tubes (e.g., less than or equal to approximately 1 mm in diameter). Microchannel heat exchangers can provide a variety of advantages over conventional finned heat exchanger tubes including higher heat transfer ratios, reduced refrigerant charge, smaller and more compact design, lower weight, and higher energy efficiency of the overall system.

SUMMARY

Despite the various air systems presently available, there are opportunities to further increase the efficiency and performance of air systems. Moreover, there are opportunities to provide air systems having increased efficiency and performance while also limiting associated manufacturing costs. These and other problems can be addressed by the technologies described herein.

The disclosed technology includes a system comprising a first interlaced microchannel heat exchanger and a second interlaced microchannel heat exchanger. The system can include a first refrigerant circuit comprising a first compressor, the first interlaced microchannel heat exchanger, a first thermal expansion valve, and the second interlaced microchannel heat exchanger. The system can include a second refrigerant circuit fluidly separated from the first refrigerant circuit, the second refrigerant circuit comprising a second compressor, the first interlaced microchannel heat exchanger, a second thermal expansion valve, and the second interlaced microchannel heat exchanger.

The first compressor and the second compressor can be the same size. Alternatively, the first compressor and the second compressor can be different sizes.

The first refrigerant circuit and the second refrigerant circuit can include the same refrigerant. Alternatively, the first refrigerant circuit can include a first refrigerant, and the second refrigerant circuit can include a second refrigerant that is different from the first refrigerant.

The first refrigerant circuit can include a refrigerant charge quantity that is the same as a refrigerant charge quantity of the second refrigerant circuit. Alternatively, the first refrigerant circuit can include a first refrigerant charge quantity, and the second refrigerant circuit can include a second refrigerant charge quantity that is different from the first refrigerant charge quantity.

The system can include a first reversing valve in fluid communication with the first refrigerant circuit and a second reversing valve in fluid communication with the second refrigerant circuit. The system can include a controller configured to independently control the first compressor, the second compressor, the first reversing valve, and the second reversing valve. The controller can be configured to output instructions to the first compressor, the second compressor, the first reversing valve, and the second reversing valve for operating in a defrost mode. The instructions for operating in a defrost mode can cause (i) the first reversing valve to direct refrigerant through the first refrigerant circuit in a first flow direction and (ii) the second reversing valve to direct refrigerant through the second refrigerant circuit in a second flow direction that is opposite the first flow direction.

The first interlaced microchannel heat exchanger can be located at an indoor location and the second interlaced microchannel heat exchanger is located at an outdoor location.

The first interlaced microchannel heat exchanger can include an inlet header and a plurality of heat exchanger tubes. Each of the plurality of heat exchanger tubes can include a plurality of microchannels configured to flow refrigerant therethrough. The first interlaced microchannel heat exchanger can include a distributor tube located within the inlet header, and the distributor tube can include a plurality of apertures. Each aperture can be aligned with at least one corresponding microchannel of the plurality of microchannels such that the aperture can thereby permit the refrigerant to flow through the at least one corresponding microchannel of the plurality of microchannels.

A portion of the distributor tube can prevent or limit the refrigerant from flowing through at least one of the plurality of microchannels. The portion of the distributor tube can prevent or limit the refrigerant from flowing through at least one of the plurality of heat exchanger tubes.

A portion of the distributor tube can increase an amount or flow rate of refrigerant flowing through at least one of the plurality of microchannels, and/or a portion of the distributor tube can increase an amount or flow rate of the refrigerant flowing through at least one of the plurality of heat exchanger tubes.

At least one of the plurality of apertures can have a size that is approximately equal to a size of at least one corresponding microchannel of the plurality of microchannels. Alternatively or in addition, at least one of the plurality of apertures can have a size that is smaller than a size of at least one corresponding microchannel of the plurality of microchannels.

The plurality of apertures of the distributor tube can include a first aperture having a first size and a second aperture having a second size that is smaller than the first size. The first size can be smaller than a size of a microchannel of the plurality of microchannels. The second size can be smaller than the size of the microchannel of the plurality of microchannels.

The first interlaced microchannel heat exchanger can include one or more baffles, and each of the one or more baffles can be configured to inhibit airflow through a portion of the first interlaced microchannel heat exchanger.

Various aspects of the present disclosure are expressly described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE FIGURES

Reference will now be made to the accompanying figures, which are not necessarily drawn to scale, and wherein.

DETAILED DESCRIPTION

Figure 1:
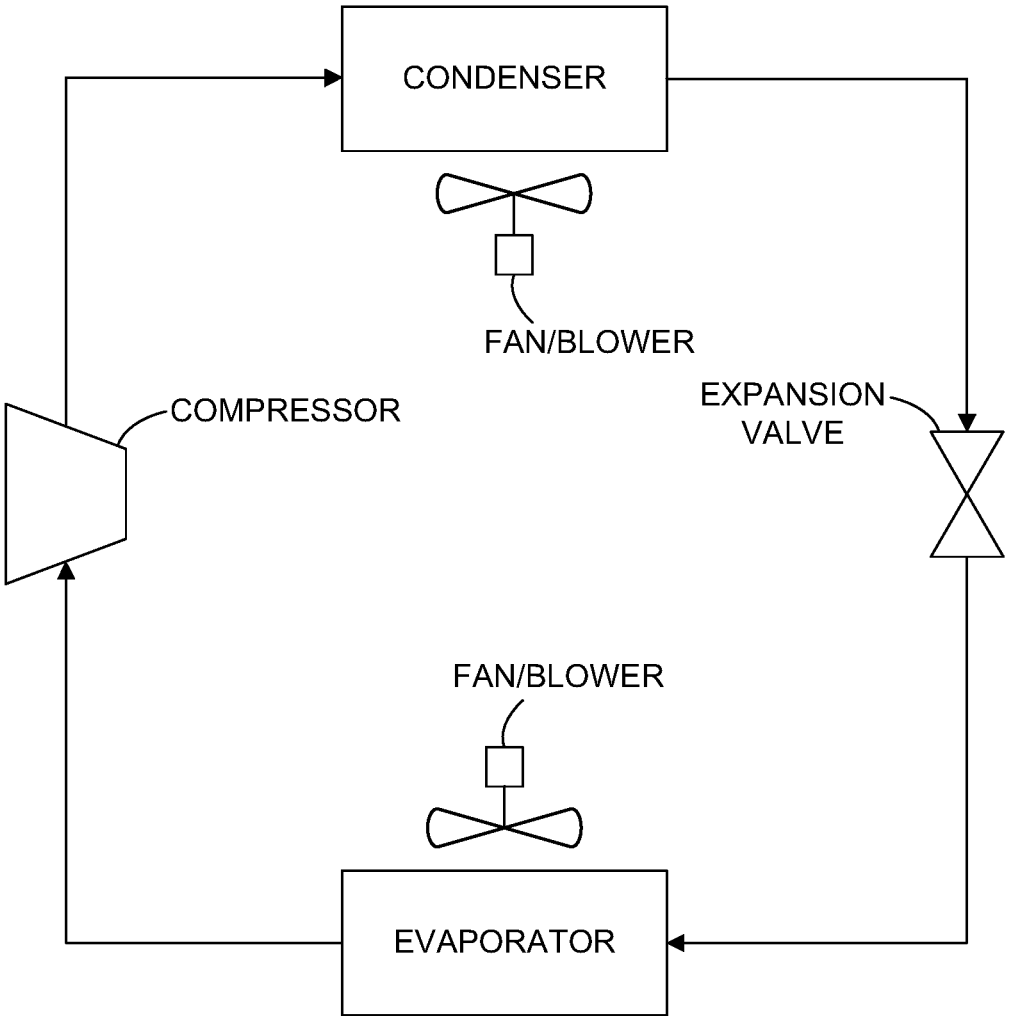
FIG. 1 PRIOR ART
FIG. 1 illustrates a schematic view of an example prior art refrigerant circuit.
Figure 2:
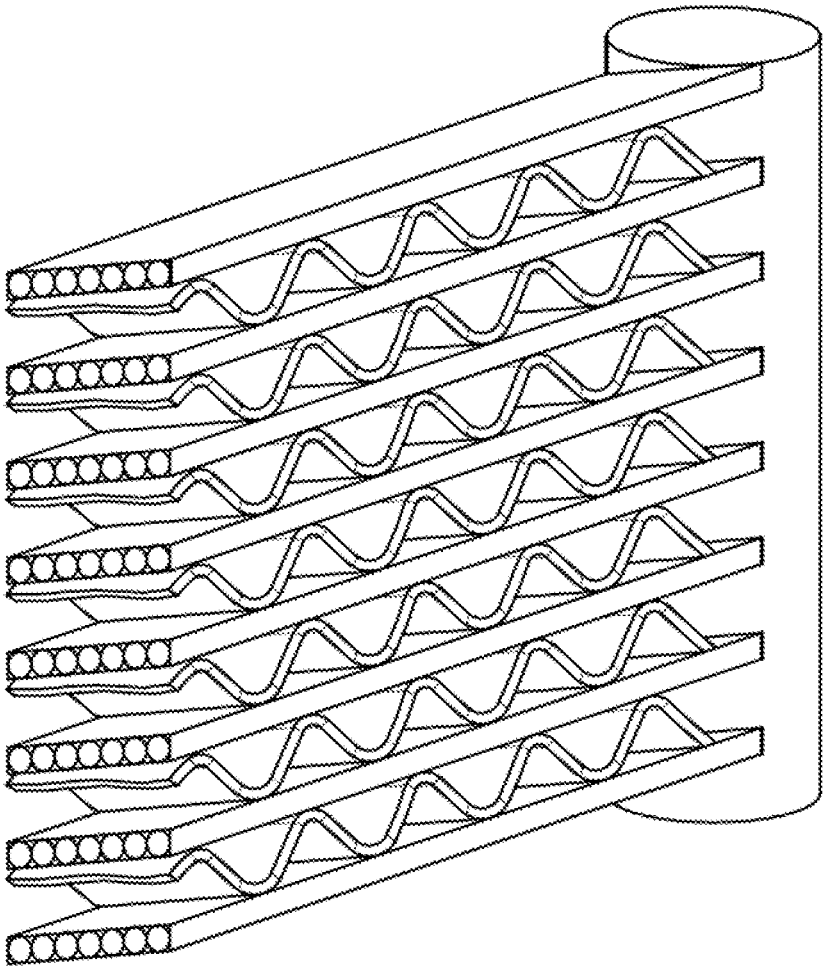
FIG. 2 PRIOR ART
FIG. 2 illustrates a partial cross-sectional view of an example prior art microchannel heat exchanger.

The disclosed technology relates to a multi-circuit air system that includes a plurality of fluidly separated refrigerant circuits, and each of the refrigerant circuits can flow through a single indoor heat exchanger (e.g., evaporator) and a single outdoor heat exchanger (e.g., condenser). As will be described more fully herein, refrigerant can be selectively flowed through each individual refrigerant circuit. This can enable the air system to provide a full-load efficiency comparable to existing air systems while also providing increased part-load efficiency. That is, at part-load, the disclosed technology can be configured to selectively operate fewer than the total number of the refrigerant circuits. In addition to providing an increased part-load efficiency, the disclosed technology can provide air systems having lower cost (e.g., manufacturing cost, installation cost, operating cost), increased reliability, and compactness (e.g., of the indoor heat exchanger).

The disclosed technology will be described more fully hereinafter with reference to the accompanying drawings. This disclosed technology can, however, be embodied in many different forms and should not be construed as limited to the examples set forth herein. The components described hereinafter as making up various elements of the disclosed technology are intended to be illustrative and not restrictive. Such other components not described herein may include, but are not limited to, for example, components developed after development of the disclosed technology.

In the following description, numerous specific details are set forth. But it is to be understood that examples of the disclosed technology can be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," "one example," "an example," "some examples," "certain examples," "various examples," etc., indicate that the embodiment(s) and/or example(s) of the disclosed technology so described may include a particular feature, structure, or characteristic, but not every embodiment necessarily includes the particular feature, structure, or characteristic. Further, repeated use of the phrase "in one embodiment" or the like does not necessarily refer to the same embodiment, example, or implementation, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referenced and are not intended to imply that the objects so described should be in a given sequence, either temporally, spatially, in ranking, or in any other manner.

Throughout this disclosure, reference is made to the accompanying drawings in which like numerals represent like elements. Certain groups of elements and/or components are referenced generally using a common numeral, while specific instances of the element and/or component are referenced using the numeral followed by a corresponding alphanumeric reference. For example, this disclosure references refrigerant circuits of the disclosed technology generally using reference numeral 110, whereas reference to specific refrigerant circuits is made herein using reference numerals 110*a*, 110*b*, and/or 110*c*. The same convention is applied to certain other elements and/or components (e.g., compressors, thermal expansion valves, reversing valves).

Unless otherwise specified, all ranges disclosed herein are inclusive of stated end points, as well as all intermediate values. By way of example, a range described as being "between approximately 2 and approximately 4" includes the values 2 and 4 and all intermediate values within the range. Likewise, the expression that a property "can be in a range from approximately 2 to approximately 4" (or "can be in a range from 2 to 4") means that the property can be approximately 2, can be approximately 4, or can be any value therebetween.

Figure 3A:
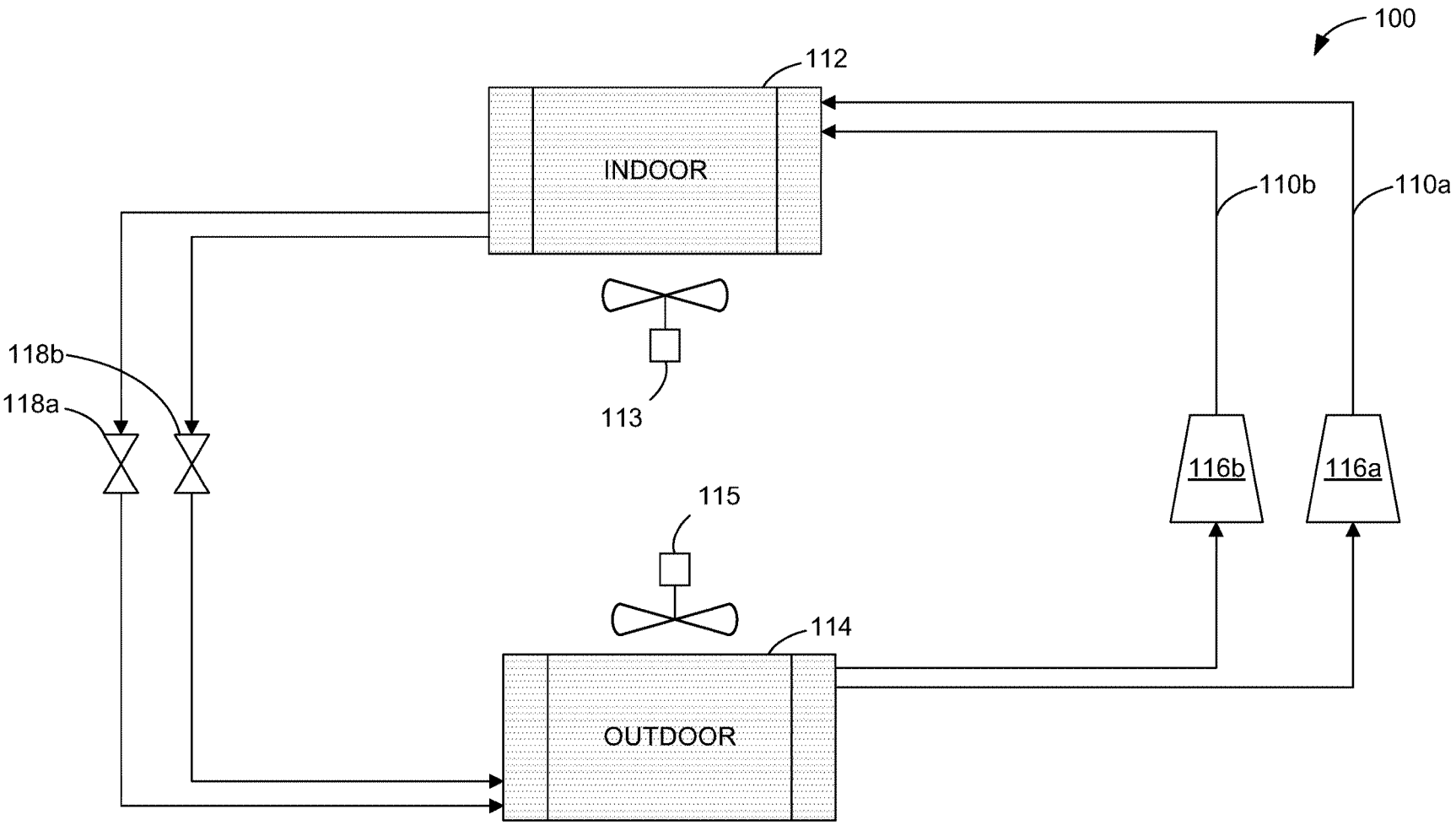
FIG. 3A illustrates a schematic view of an example air system, in accordance with the disclosed technology.
Figure 3B:
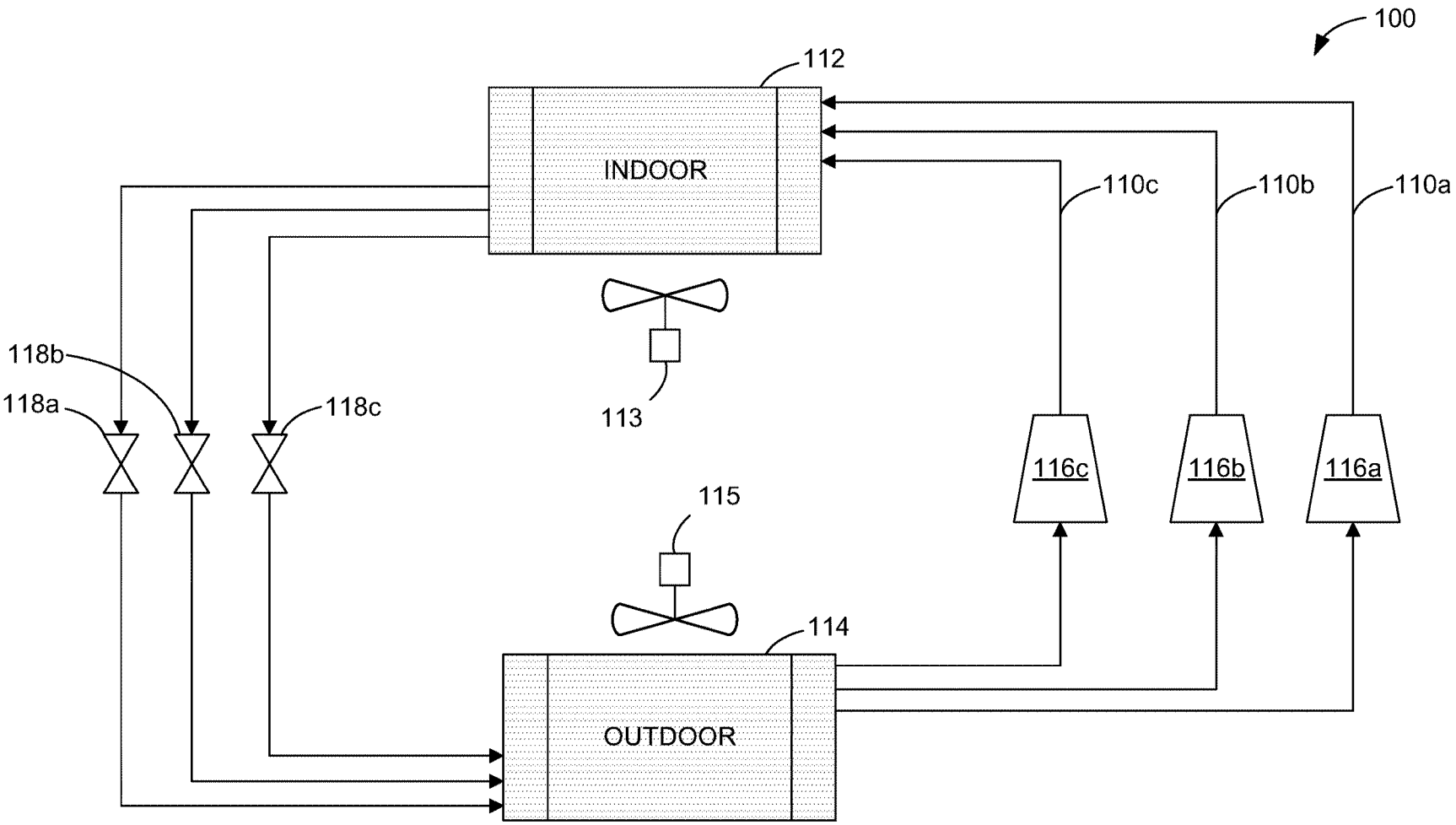
FIG. 3B illustrates a schematic view of another example air system, in accordance with the disclosed technology.

Referring now to FIGS. 3A and 3B, an air system 100 can include a plurality of fluidly separated refrigerant circuits 110, and all of the refrigerant circuits 110 can be configured to pass through a single, shared indoor interlaced microchannel heat exchanger (iMCHX) 112 (also referenced herein as indoor coil 112) and a single, shared outdoor iMCHX 114 (also referenced herein as outdoor coil 114). The air system can also include a blower or fan 113 configured to move air across the indoor iMCHX and a blower or fan 115 configured to move air across the outdoor iMCHX 114. Each of the refrigerant circuits 110 can include its own compressor 116 and expansion valve 118. For example, FIG. 3A illustrates an air system 100 having multiple refrigerant circuits 110 that each include a corresponding compressor 116 and a corresponding expansion valve 118, which includes a first refrigerant circuit 110*a* that includes a first compressor 116*a* and a first expansion valve 118*a*, as well as a second refrigerant circuit 110*b* that includes a second compressor 116*b* and a second expansion valve 118*b*.

As will be appreciated by those having skill in the art, the interlaced aspect of the iMCHXs enables the system 100 to connect multiple, fluidly separated refrigerant circuits though a single indoor heat exchanger (e.g., acting as an evaporator) and a single outdoor heat exchanger (e.g., acting as a condenser). This configuration provides a high part-load efficiency compared to traditional microchannel heat exchangers by increasing the available surface area and airflow for heat transfer. One or both of the indoor iMCHX and outdoor iMCHX can have a counter-flow circuit configuration, and/or one or both of the indoor iMCHX and outdoor iMCHX can have a parallel-flow circuit configuration.

Each of the refrigerant circuits 110 can include the same type of refrigerant (e.g., R-410A, R-454B). Conversely, one, some, or all of the refrigerant circuits 110 can include a different type of refrigerant.

Each of the refrigerant circuits 110 can have the same charge quantity. Conversely, one, some, or all of the refrigerant circuits 110 can have a different charge quantity.

Each of the refrigerant circuits 110 can have the same type and/or size of compressor 116. Conversely, one, some, or all of the compressors 116 can be a different type and/or a different size. A system including compressors 116 of the same size will provide a comparatively simple design, whereas a system 100 including compressors 116 of differing sizes can provide a comparatively higher efficiency, particularly under partial-load conditions. For example, referring to FIG. 3A, the air system 100 can include two refrigerant circuits 110, which can include a first refrigerant circuit 110*a* having a first compressor 116*a* and a second refrigerant circuit 110*b* having a second compressor 116*b*. The first compressor 116*a* can be smaller than the second compressor 116*b* such that (1) the first compressor 116*a* can be operated at low partial-load conditions (e.g., based on a low amount of cooling required), (2) the larger, second compressor 116*b* can be operated at high partial-load conditions (e.g., based on a middle amount of cooling required), and (3) both of the first and second compressors 116*a*, 116*b* can be operated at full-load conditions (e.g., based on a high amount of cooling required).

Likewise, referring to FIG. 3B, the air system 100 can include three refrigerant circuits 110, which can include a first refrigerant circuit 110*a* having a first compressor 116*a*, a second refrigerant circuit 110*b* having a second compressor 116*b*, and a third refrigerant circuit 110*c* having a third compressor 116*c*. As discussed above, some or all of the three compressors 116 can be the same size, and/or some or all of the three compressors 116 can be different sizes. For example, the first compressor 116*a* can be smaller than the second and third compressors 116*b*, 116*c*, and the second and third compressors 116*b*, 116*c* can be the same size. Thus, the system 100 can be configured to operate one compressor 116 under a lower partial-load condition, operate two compressors 116 under a higher partial-load condition, and operate all three compressors 116 under a full-load condition. The air system 100 can also be configured to operate various combinations of the compressors 116 to approximately match (or match as nearly as possible) the current load condition. Optionally, the air system 100 can be configured to rotate which of the compressors 116 is operated under partial-load conditions (e.g., based on total runtime, time since last use, etc.), particularly among compressors 116 of the same or approximately the same size.

As another example, the first compressor 116*a* can be smaller than the second compressor 116*b*, and the second compressor 116*b* can be smaller than the third compressor 116*c*. Thus, the system 100 can be configured to operate (1) the first compressor 116*a* under a first partial-load condition, (2) the second compressor 116*b* under a second partial-load condition, (3) and the third compressor 116*c* under a third partial-load condition, (4) both the first and second compressors 116*a*, 116*b* under a fourth partial-load condition, (5) both the first and third compressors 116*a*, 116*c* under a fifth partial-load condition, (6) both the second and third compressors 116*b*, 116*c* under a sixth partial-load condition, and (7) operate all three compressors 116 under a full-load condition. Each of these partial-load conditions can be a different partial load condition (e.g., a different amount of cooling required).

Although FIGS. 3A and 3B illustrate the possibilities of either dual-circuit or tri-circuit configurations, the air system 100 can include any number of refrigerant circuits 110. For example, the disclosed technology includes any number of refrigerant circuits 110, such as four, five, or more. As will be appreciated, a higher number of refrigerant circuits 110 will increase the granularity by which the system 100 can address partial-load conditions, but increasing the number of refrigerant circuits 110 also increases the number of components (e.g., compressors 116) required, which can, at some point, become unnecessarily or undesirably costly.

Regardless of the number of refrigerant circuits 110, the air system 100 can be configured such that each partial-load condition corresponds to the operation of one or more compressors 116 at its individualized full capacity. And because compressors 116 are typically most efficient during full-load operation, the overall efficiency of the air system 100 can be greater than that of traditional systems.

Alternatively or in addition, one or more of the compressors 116 can be a two-step compressor. Alternatively or in addition, one or more of the compressors can be configured to utilize a variable frequency drive (VFD) (e.g., at partial-load only, at all loads).

Moreover, while FIGS. 3A and 3B illustrate example air heating systems, the disclosed technology can be included in air cooling systems and/or heat pump systems, which can operate in a heating mode to provide air heating to the indoor space or in a cooling mode to provide air cooling to the indoor space. In addition, the disclosed technology can be included in a heat pump system that is configured to provide both heating and cooling to the indoor space. For example, each refrigerant circuit 110 of the air system 100 can include a reversing valve or another device or system configured to enabling reversing of the refrigerant flow through the refrigerant circuit 110. In such a configuration, the air system 100 can provide efficient heating under both full- and partial-load heating conditions and can provide efficient cooling under both full- and partial-load cooling conditions. Moreover, the air system 100 can operate in a defrost mode to prevent or remove ice from the outdoor coil, which can accumulate on the outdoor coil when it is acting as an evaporator (i.e., when the air system 100 is operating in the heating mode). For simplicity's sake, the defrost mode is discussed herein with respect to the outdoor coil 114, but it is possible that the indoor coil 114 may accumulate frost or ice and need to be defrosted. As such, the various methods discussed herein can, alternatively or in addition, be applied to the indoor coil 114.

The air system 100 can include one or more sensors to determine in which mode the air system should operate and/or to determine whether a buildup of frost or ice on the outdoor coil 114 (or the indoor coil) has occurred or is likely to occur. For example, the air system 100 can include a coil temperature sensor, which can be configured to measure the temperature of the refrigerant in or near the outdoor coil 114 and output the measured temperature to the controller 400. The coil temperature sensor can be configured to measure the temperature of the outdoor coil 114 continuously or periodically when the air system 100 is shut down, while the air system 100 is operating, or both. The coil temperature sensor can be installed directly on the surface of the outdoor coil 114, inside of the outdoor coil 114, partially inside of the outdoor coil 114, or near the outdoor coil 114. Additionally, the coil temperature sensor can be configured to measure the surface temperature, the core temperature, a temperature of a portion of the outdoor coil 114, or any other method of measuring as would be suitable for the particular application and arrangement. The coil temperature sensor can include any type of sensor capable of measuring the temperature of the outdoor coil 114. For example, the coil temperature sensor can be or include a thermocouple, a resistor temperature detector (RTD), a thermistor, an infrared sensor, a semiconductor, or any other suitable type of sensor for the application.

Alternatively or in addition, the one or more sensors can include an ambient temperature sensor (e.g., a thermocouple, an RTD, a thermistor, an infrared sensor, a semiconductor), which can be configured to detect a temperature of the ambient air to indicate environmental conditions near the outdoor coil 114. Alternatively or in addition, the one or more sensors can include a humidity sensor (e.g., capacitive, resistive, thermal), which can be configured to detect a humidity of the ambient air (e.g., relative humidity).

Optionally, the blower 113 and/or the fan 115 can be configured to utilize a VFD. As will be appreciated, this can enable the system 100 to modulate the speed of the blower 113 and/or the fan 115 to provide an increased or decreased amount of air flow, which can be modulated based on the amount of heating or cooling required, as a non-limiting example. It should also be understood that, while the terms "blower" and "fan" are used herein, either term refers generally to any air moving device configured to move air across an iMCHX.

Figure 4:
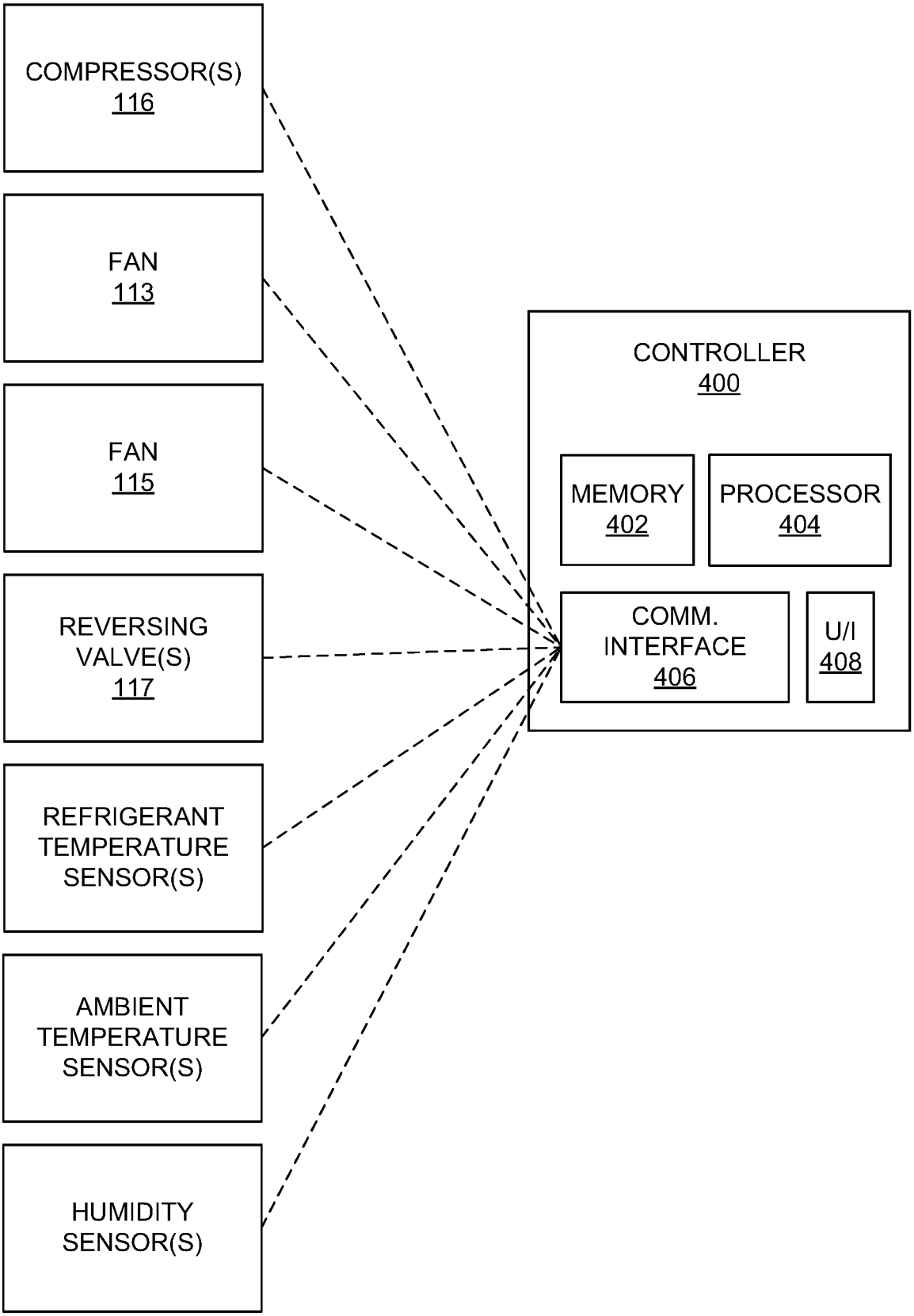
FIG. 4 illustrates a schematic diagram of an example controller for an air system, in accordance with the disclosed technology.

Referring to FIG. 4, the controller 400 of the air system 100 can be configured to control operation of various components of the air system 100, such as the various compressors 116 and/or valves (e.g., reversing valves 117 as described more fully herein). The controller 400, as illustrated in FIG. 4, can have memory 402, one or more processors 404, a communication interface 406, and/or a user interface 408. The memory 402 can have instructions stored thereon that, when executed by the processor(s) 404, cause the air system 100 to perform actions, methods, or processes, such as those described herein. More specifically, the controller 400 can be configured to receive data (e.g., via the communication interface 406) from one or more sensors (e.g., temperature sensor(s) configured to measure refrigerant temperature at or near one or both heat exchangers 102, 104, ambient temperature sensor(s) located at or near one or both heat exchangers 102, 104, humidity sensor(s) located at or near one or both heat exchangers 102, 104), make certain determinations as discussed more fully herein, and output instructions (e.g., via the communication interface 406) for operation of one or more components of the air system 100 (e.g., compressor(s) 116, fan 113, fan 115, and/or reversing valve(s) 117).

One of skill in the art will understand that the controller 400 can be installed in any location, provided the controller 400 is in communication with at least some of the components of the air system 100. Furthermore, the controller 400 can be configured to send and receive wireless or wired signals and the signals can be analog or digital signals. The wireless signals can include Bluetooth™, BLE, WiFi™, ZigBee™, infrared, microwave radio, or any other type of wireless communication as may be appropriate for the particular application. The hard-wired signal can include any directly wired connection between the controller and the other components. For example, the controller 400 can have a hard-wired 24 VAC connection to the compressor(s) 116. Alternatively, the components can be powered directly from a power source and receive control instructions from the controller 400 via a digital connection. The digital connection can include a connection such as an Ethernet or a serial connection and can utilize any appropriate communication protocol for the application such as Modbus, fieldbus, PROFIBUS, SafetyBus p, Ethernet/IP, or any other appropriate communication protocol for the application. Furthermore, the controller 400 can utilize a combination of wireless, hard-wired, and analog or digital communication signals to communicate with and control the various components. One of skill in the art will appreciate that the above configurations are given merely as non-limiting examples and the actual configuration can vary depending on the application.

Figure 5A:
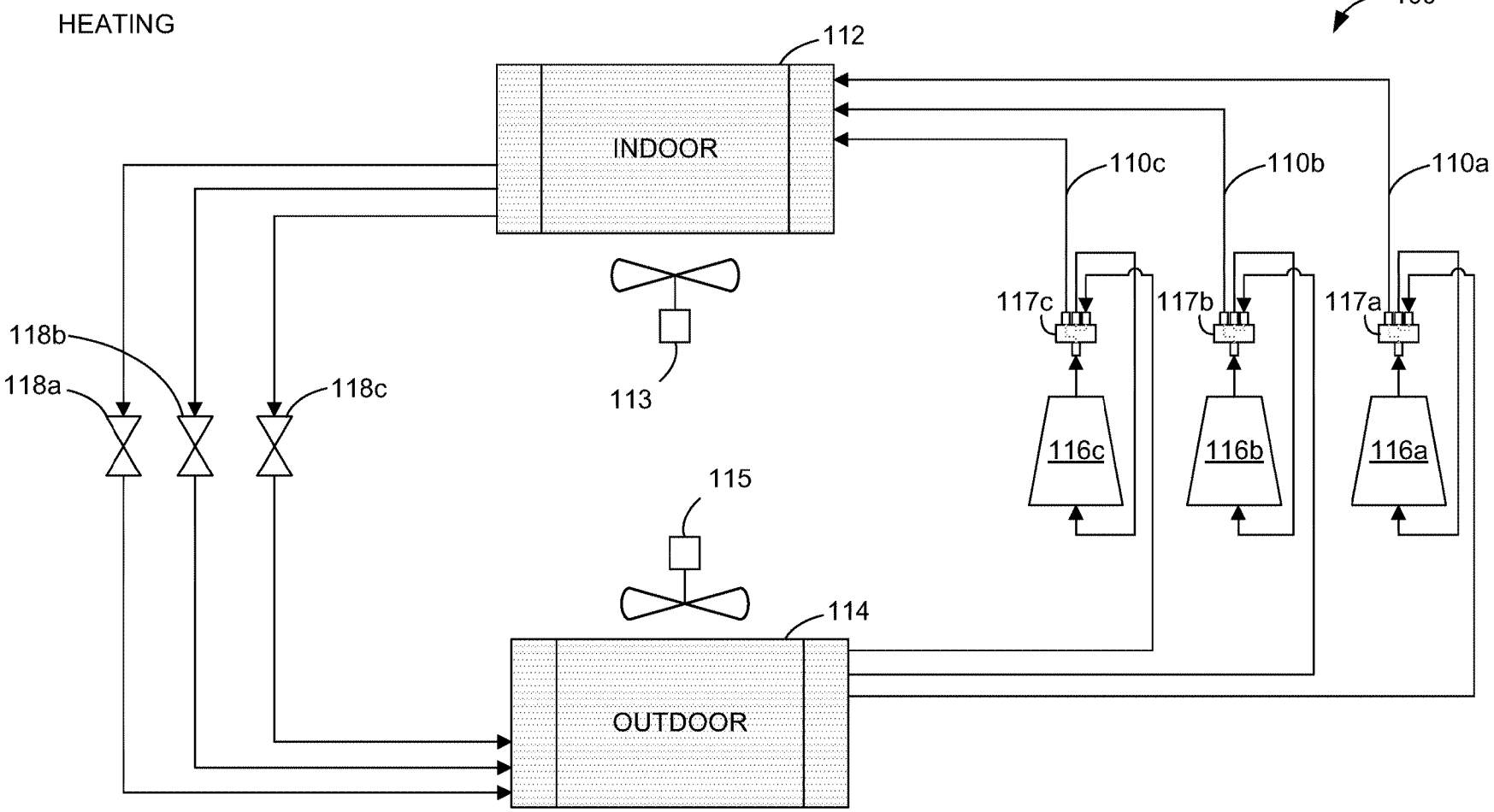
FIGS. 5A-5C illustrate schematic view of an example air system operating in a heating mode, a cooling mode, and a defrost mode, respectively, in accordance with the disclosed technology.
Figure 5B:
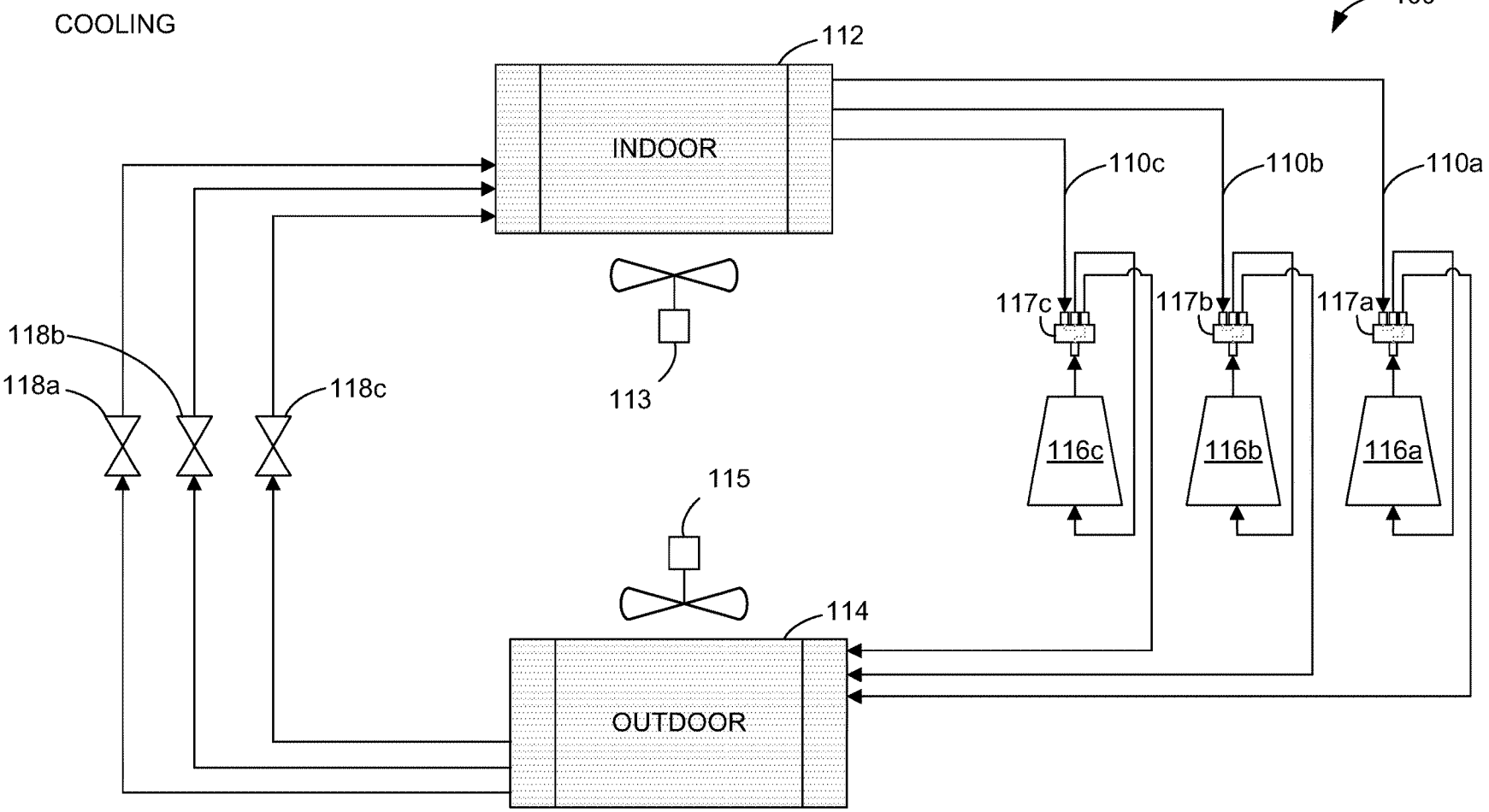
Figure 5C:
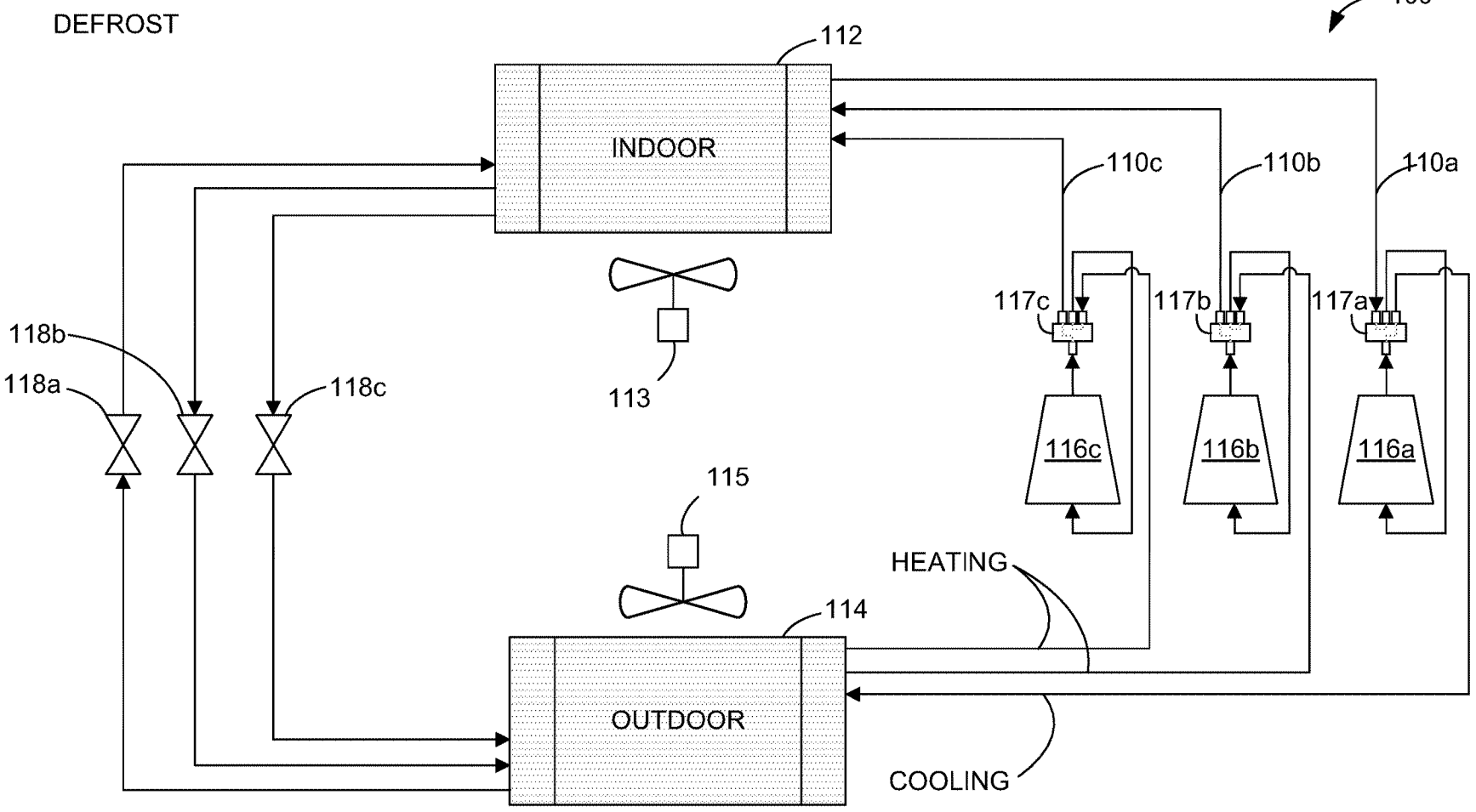

Referring to FIGS. 5A-5C, operation of the air system 100 during full heating mode, full cooling mode, and defrost mode are illustrated, respectively. "Full heating mode" can refer to an operational mode in which all refrigerant circuits 110 are providing heat to the conditioned space via the indoor coil 112 such that the indoor coil 112 is acting as a condenser. Likewise, "full cooling mode" can refer to an operational mode in which all refrigerant circuits 110 are providing cooling to the conditioned space via the indoor coil 112 such that the indoor coil 112 is acting as an evaporator. To change a given refrigerant circuit 110 between operational modes, the air system 100 (e.g., controller 400) can output instructions for the corresponding reversing valve 117 (e.g., a four-way reversing valve) to selectively direct refrigerant through the refrigerant circuit 110 in a particular flow direction.

In defrost mode, at least one of the refrigerant circuits 110 is operating in a heating mode such that heat is discharged from the corresponding refrigerant at the indoor coil 112 (illustrated in FIG. 5C as refrigerant circuits 110*b*, 110*c*), while at least one other refrigerant circuit 110 is operating in a cooling mode such that heat is discharged from the corresponding refrigerant at the outdoor coil 114 (illustrated in FIG. 5C as refrigerant circuit 110*a*). As such, the heat discharged at the outdoor coil 114 can help melt or prevent frost or ice accumulation on the outdoor coil 114. Once the temperature of the outdoor coil 114 has been sufficiently increased (or other metrics become satisfied), operation in the defrost mode can cease. As such, the flow of refrigerant in the refrigerant circuit 110 that was discharging heat at the outdoor coil 114 can be reversed (such that heat is no longer being discharged at the outdoor coil 114 but is instead being discharged at the indoor coil 114) or ceased (i.e., the corresponding compressor 116 can be turned off). During defrost mode, the controller 400 can be configured to operate any number of refrigerant circuits 110 to discharge heat at the outdoor coil 114. For example, as illustrated, the defrost mode can include one refrigerant circuit 110 discharging heat at the outdoor coil 114. Alternatively, the defrost mode can include all refrigerant circuits 110 except one discharging heat at the outdoor coil 114. The particularly refrigerant circuit(s) 110 and/or the number of refrigerant circuits(s) operated to discharge heat at the outdoor coil 114 can be based at least in part on the temperature of the outdoor coil, the ambient environmental conditions (e.g., temperature, humidity), the current indoor temperature, and/or the indoor heating load.

Regardless, when the temperature of the outdoor coil 114 falls below a certain temperature threshold, (e.g., 50° F.), the air system 100 can be unable to efficiently provide heat to the indoor space. Indeed, condensation accumulated on the outdoor coil 114 can freeze, causing a buildup of frost and ice. In these conditions, frost can accumulate to the point where the air system 100 operates with a degraded performance or components become damaged. Accordingly, the air system 100 (e.g., controller 400) can be configured to transition to defrost mode upon detection that the measured temperature (e.g., coil temperature, ambient temperature) is less than a corresponding temperature threshold value and/or the measured humidity is greater than a humidity threshold value.

Figure 6A:
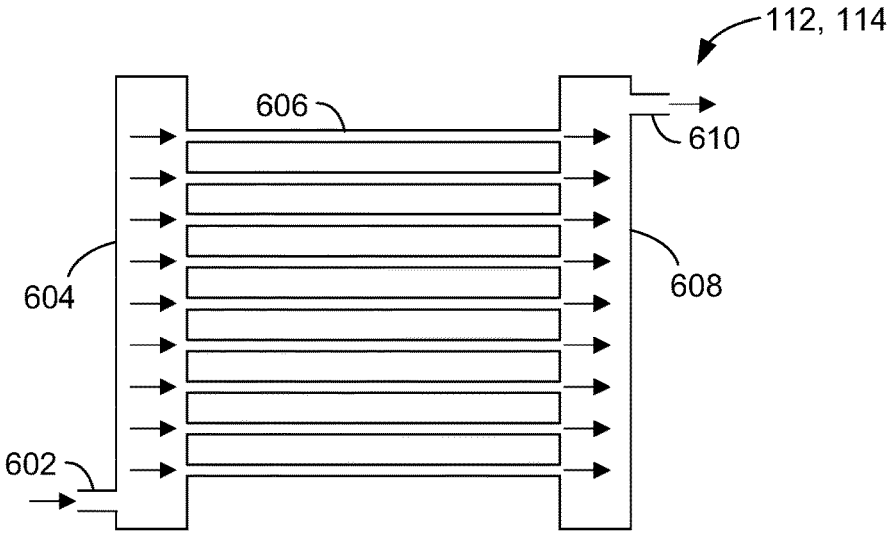
FIG. 6A illustrates a schematic view of a refrigerant circuit in an example heat exchanger, in accordance with the disclosed technology.
Figure 6B:
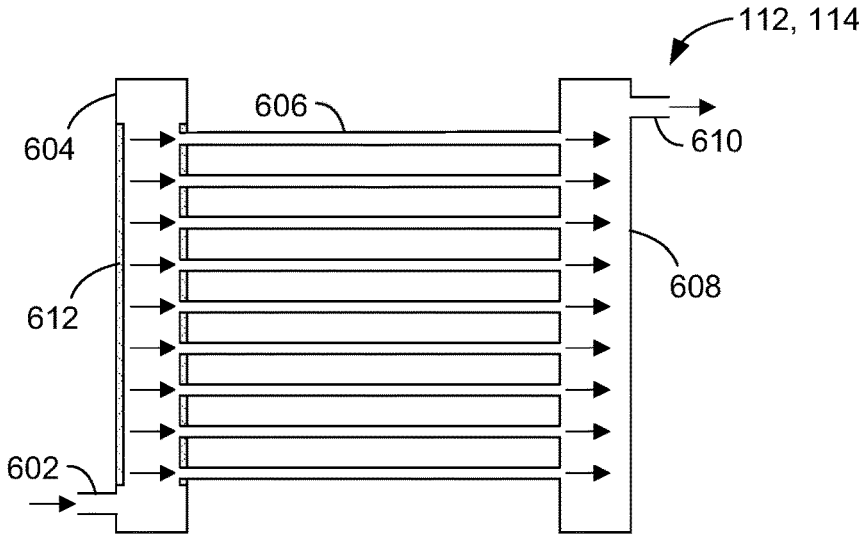
FIGS. 6B and 6C illustrate schematic views of a refrigerant circuit in an example heat exchanger having a distributor tube, in accordance with the disclosed technology.
Figure 6C:
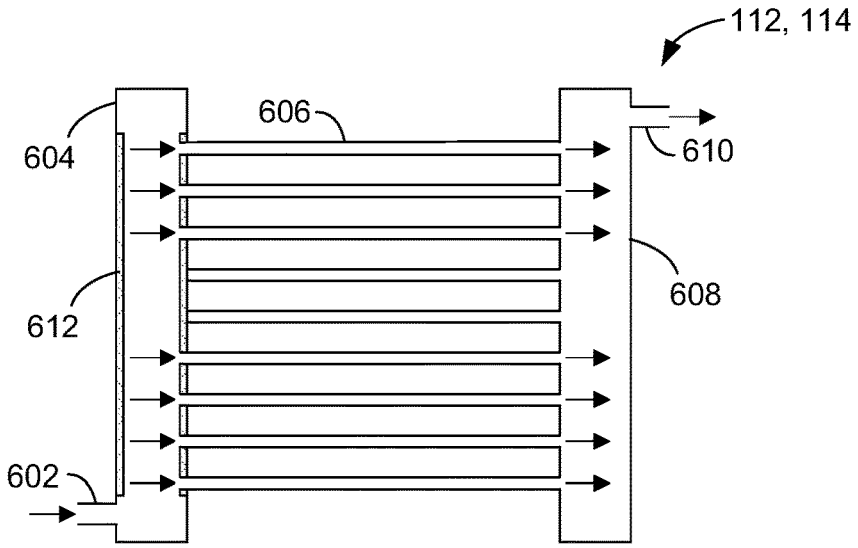

FIGS. 6A-6C illustrate schematic diagrams of a single refrigerant circuit 110 for a given interlaced microchannel heat exchanger (e.g., indoor coil 112 or outdoor coil 114). As shown in FIG. 6A, refrigerant can flow into the heat exchanger 112, 114 via an inlet 602 and into an inlet header 604. The inlet header 604 can be in fluid communication with several heat exchanger tubes 606, and the inlet header 604 can therefor distribute the refrigerant among the heat exchanger tubes 606. As described more fully herein, each heat exchanger tube 606 includes multiple microchannels, each microchannel having its own flow path through the heat exchanger tube 606. The tubes can be stacked and/or can have a generally flat profile or shape. The refrigerant can flow out of the various heat exchanger tubes 606 into the outlet header 608 and can ultimately exit the heat exchanger 112, 114 via the outlet 610.

As will be appreciated, various heat exchanger designs can have varying airflow concentrations as air flows across the heat exchanger tubes 606 of the heat exchanger 112, 114. As such, it can be desirable to direct refrigerant to those areas with a high airflow concentration and restrict refrigerant from flowing to areas with low airflow concentration. In this way, the heat transfer efficiency of the heat exchanger 112, 114 can be increased. Referring to FIGS. 6B and 6C, a distributor tube 612 can be included. The distributor tube 612 can be configured to selectively permit refrigerant to pass to a given heat exchanger tube 606 and/or to a given microchannel of a given heat exchanger tube 606. The distributor tube 612 can be a tube having an external diameter that is approximately equal to an internal diameter of the inlet header 604. The distributor tube 612 can have a plurality of apertures extending through the sidewall of the distributor tube 612, and each aperture can be configured to align with some or all of a given heat exchanger tube 606. As such, the apertures can permit refrigerant to enter the corresponding heat exchanger tube(s) 606.

The heat exchanger 112, 114 can include the same distributor tube 612 for each refrigerant circuit 110. Alternatively, the heat exchanger 112, 114 can include one or more different distributor tubes 612 for different refrigerant circuits 110. For example, as shown in FIG. 6B, a first distributor tube 612 can be configured to permit refrigerant to flow through all heat exchanger tubes 606 of a first refrigerant flow path (e.g., refrigerant flow path 110*a*), while, as shown in FIG. 6C, a second distributor tube 612 can be configured to permit refrigerant to flow through only some heat exchanger tubes 606 of a second refrigerant flow path (e.g., refrigerant flow path 110*b*). That is to say, the distributor tube 612 can be configured to block passage through some or all of a given heat exchanger tube 606. Alternatively or in addition, the distributor tube can be configured to increase an amount or flow rate of the refrigerant flowing through one or some of microchannels (e.g., microchannels 702 as discussed more fully herein) and/or can increase an amount or flow rate of the refrigerant flowing through one or some of the heat exchanger tubes 606 (e.g., as an effect of blocking, preventing, and/or limiting flow in one or more other heat exchanger tubes 606 and/or one or more other microchannels (e.g., microchannels 702).

Figure 7A:
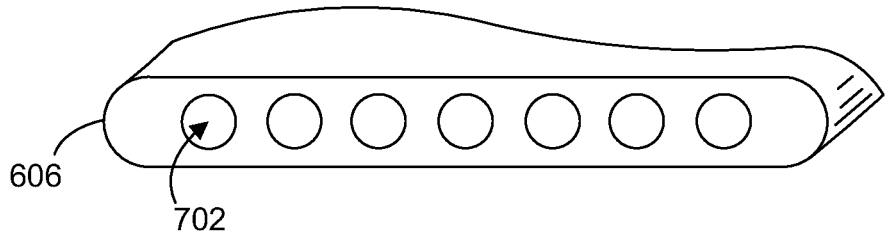
FIG. 7A illustrates an end view of tube of an example microchannel heat exchanger, in accordance with the disclosed technology.
Figure 7B:
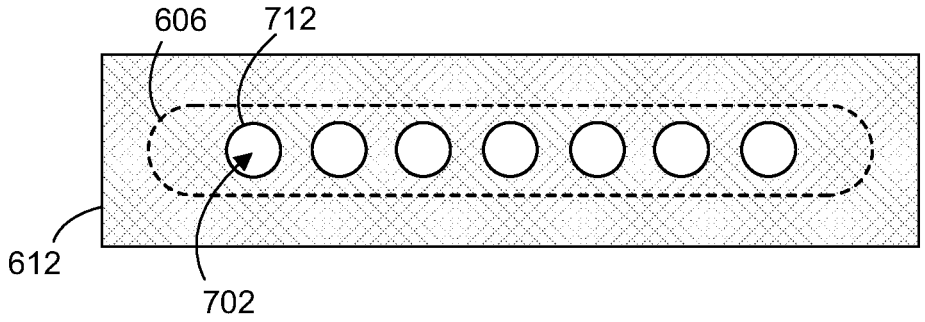
FIGS. 7B-7F illustrate various configurations of an example distributor tube interfacing with a microchannel heat exchanger, in accordance with the disclosed technology.

FIG. 7A illustrates an end view of a heat exchanger tube 606 having multiple microchannels 702. As shown in FIG. 7B, the distributor tube 612 can have a plurality of apertures 712, with each aperture aligned with a corresponding microchannel 702. In this way, the distributor tube 612 can be configured to permit refrigerant to flow through all of the microchannels 702 of that particular heat exchanger tube 606. Alternatively, the same effect can be achieved by the distributor tube 612 including a single aperture permitting refrigerant to flow to all microchannels 702 of the heat exchanger tube 606.

Figure 7C:
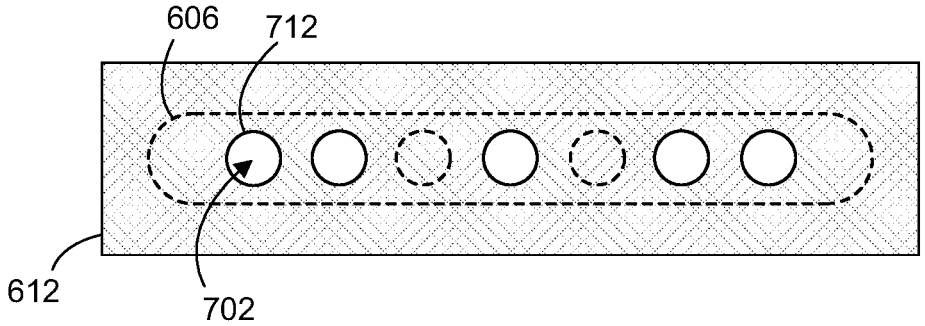
Figure 7D:
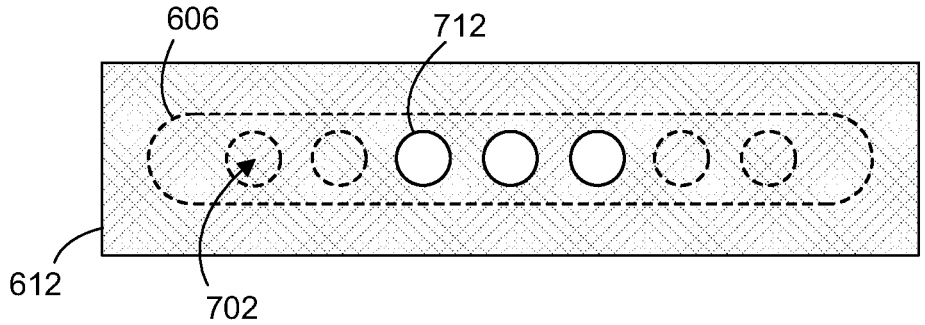

As explained, it can be advantageous to restrict refrigerant from flowing through certain heat exchanger tubes 606. Likewise, it can be advantageous to restrict refrigerant from flowing through certain microchannels 702 of a given heat exchanger tube 606, such that the heat exchanger tube 606 is passing less than a maximum throughput of refrigerant. FIG. 7C illustrates a first example configuration of apertures resulting in a corresponding configuration of open and blocked microchannels 702, and FIG. 7D illustrates a first example configuration of apertures resulting in a corresponding configuration of open and blocked microchannels 702. The disclosed technology is not so limited, however, and includes any combination of apertures or lack thereof to provide any configuration of open and blocked microchannels 702.

Figure 7E:
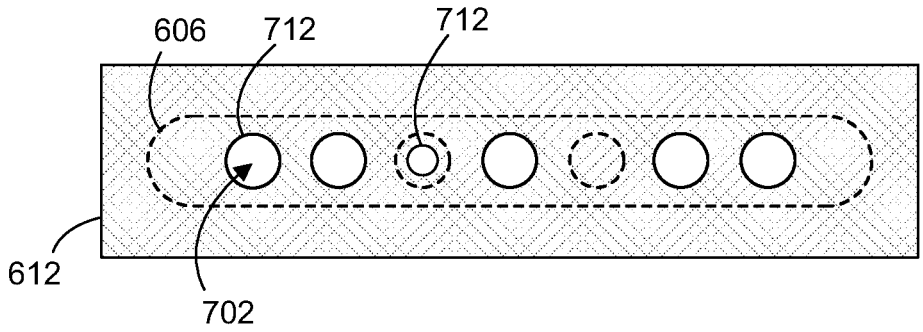
Figure 7F:
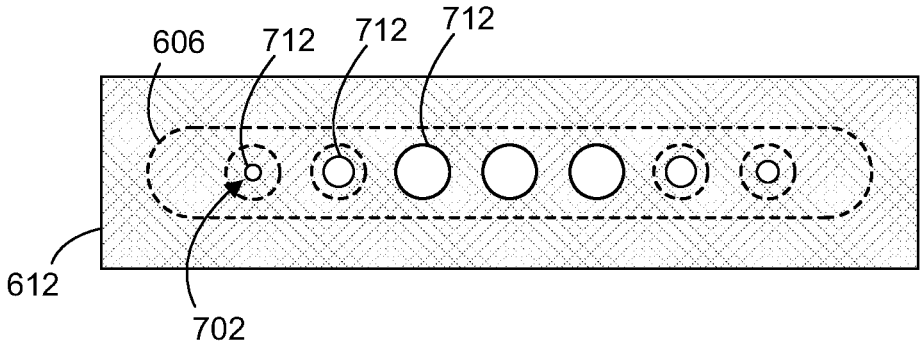

One, some, or all of the apertures 712 can have a size (e.g., diameter) that is approximately the same size as, or larger than, one or more corresponding microchannels 702 such that the corresponding microchannel(s) 702 is entirely open to receive a maximum capacity and/or throughput of refrigerant. Alternatively or in addition, the distributor tube 612 can include differently sized apertures. For example, the distributor tube 612 can include one or more apertures of a first size (e.g., first diameter) and one or more apertures of a second size (e.g., second diameter). As illustrated in FIG. 7E, the distributer tube 612 can be configured to permit full flow through some microchannels 702, permit partial flow through another microchannel 702 (due to the smaller sized aperture 712), and prevent flow through another microchannel 702 (due to the lack of a corresponding aperture 712). As illustrated in FIG. 7F, the distributor tube 612 can include multiple different sizes (e.g., diameters) of apertures 712. Although the apertures 712 and microchannels 702 are shown herein as being circular in shape, the disclosed technology includes apertures 712 and/or microchannels 702 of different shapes, such as an oval, ellipse, triangle, square, or any other polygonal shape.

Figure 8A:
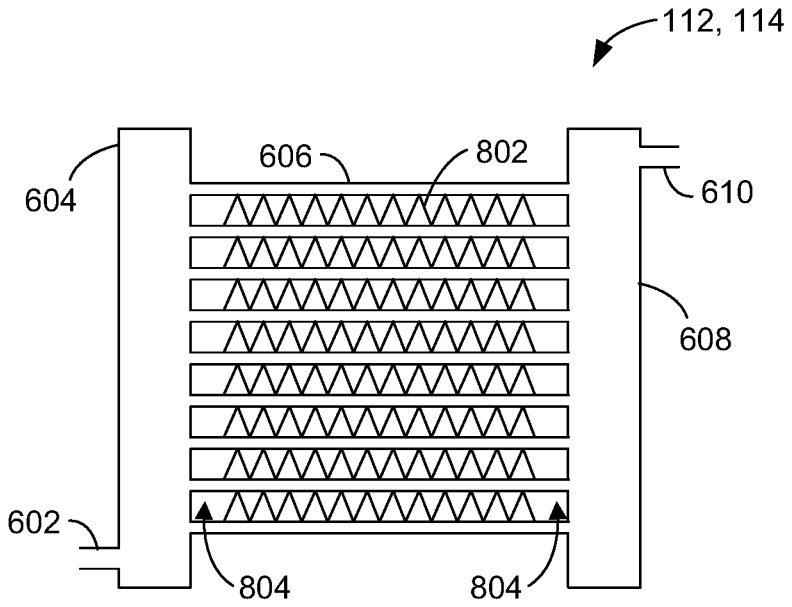
FIG. 8A illustrates a schematic view of an example heat exchanger, in accordance with the disclosed technology.
Figure 8B:
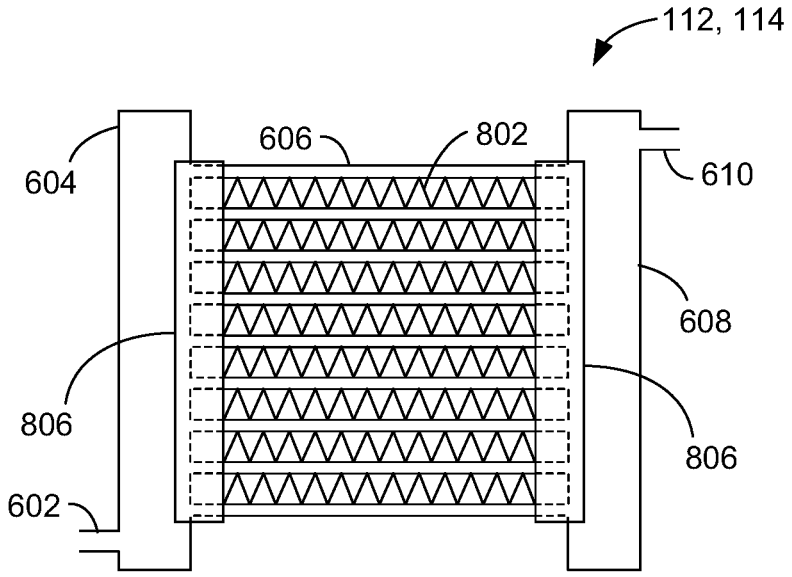
FIG. 8B illustrates a schematic view of the example heat exchanger of FIG. 8A further including baffles, in accordance with the disclosed technology.

As discussed, various heat exchanger designs can have varying airflow concentrations as air flows across the heat exchanger tubes 606 of the heat exchanger 112, 114 based on various characteristics and design elements of the heat exchanger 112, 114. Many heat exchangers 112, 114 include fins 802 to help facilitate heat transfer and increase the heat transferability and/or efficiency of the system. In certain designs, there are portions of the heat exchanger tubes 606 that do not include fins 802 and thus include a gap 804 between adjacent heat exchanger tubes 606, as shown in FIG. 8A. Alternatively or in addition, the separation between adjacent heat exchanger tubes 606 can vary (e.g., due to bends in the tubes at or near the ends of the heat exchanger 112, 114. Regardless of the cause, certain heat exchanger designs can include undesirable gaps 804 and/or gaps of an undesirable size such that an amount of air travels through the heat exchanger 112, 114 at a location with low heat transferability and/or efficiency. To help correct this issue, the disclosed technology can include one of more baffles 806. The baffle(s) 806 can be attached to the heat exchanger 112, 114 at a location corresponding to one or more gaps 804 and/or gaps of an undesirable size. For example, as illustrated in FIG. 8B, the baffle(s) 806 can be located at one or both ends of the heat exchanger tubes 606, thereby preventing or inhibiting air flow through the underlying gaps 804.

As described, the disclosed technology provides, among other things, an inexpensive design for providing enhanced partial-load efficiency in an air system, such as an air conditioning system and/or a heat pump system.

Further, certain methods and processes are described herein. It is contemplated that the disclosed methods and processes can include, but do not necessarily include, all steps discussed herein. That is, methods and processes in accordance with the disclosed technology can include some of the disclosed while omitting others. Moreover, methods and processes in accordance with the disclosed technology can include other steps not expressly described herein.

While certain examples of this disclosure have been described in connection with what is presently considered to be the most practical and various examples, it is to be understood that this disclosure is not to be limited to the disclosed examples, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain examples of the technology and also to enable any person skilled in the art to practice certain examples of this technology, including making and using any apparatuses or systems and performing any incorporated methods. The patentable scope of certain examples of the technology is defined in the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

That which is claimed is:

1. A system comprising:

a first heat exchanger;

a second heat exchanger;

a first refrigerant circuit comprising a first portion of the first heat exchanger, a first thermal expansion valve, and a first portion of the second heat exchanger; and a second refrigerant circuit fluidly separated from the first refrigerant circuit, the second refrigerant circuit comprising a second portion of the first heat exchanger, a second thermal expansion valve, and a second portion of the second heat exchanger;

wherein the first refrigerant circuit has a first refrigerant charge capacity and the second refrigerant circuit has a second refrigerant charge capacity that is different from the first refrigerant charge capacity.

2. The system of claim 1, wherein the first heat exchanger is a first interlaced microchannel heat exchanger, and the second heat exchanger is a second interlaced microchannel heat exchanger.

3. The system of claim 1, wherein the first heat exchanger comprises:

an inlet header;

a plurality of heat exchanger tubes, each of the plurality of heat exchanger tubes including a plurality of microchannels configured to flow refrigerant therethrough; and a distributor tube located at least partially within the inlet header, the distributor tube comprising a plurality of apertures, wherein each aperture is aligned with at least one corresponding microchannel of the plurality of microchannels, thereby permitting the refrigerant to flow through the at least one corresponding microchannel of the plurality of microchannels.

4. The system of claim 3, wherein the plurality of apertures of the distributor tube prevents the refrigerant from flowing through at least one of the plurality of microchannels, or at least one of the plurality of heat exchanger tubes.

5. The system of claim 3, wherein at least one of the plurality of apertures has a size that is approximately equal to a size of the at least one corresponding microchannel of the plurality of microchannels.

6. The system of claim 3, wherein at least one of the plurality of apertures has a size that is smaller than a size of the at least one corresponding microchannel of the plurality of microchannels.

7. The system of claim 1, wherein the plurality of apertures of the distributor tube comprises a first aperture having a first size that is smaller than a size of a microchannel of the plurality of microchannels, and a second aperture having a second size that is smaller than the first size.

8. The system of claim 1, wherein the first heat exchanger is configured to be located at an indoor location and the second heat exchanger is configured to be located at an outdoor location.

9. The system of claim 1, further comprising:

a first reversing valve in fluid communication with the first refrigerant circuit; and a second reversing valve in fluid communication with the second refrigerant circuit.

10. An interlaced microchannel heat exchanger comprising:

an inlet header;

a plurality of heat exchanger tubes, each of the plurality of heat exchanger tubes including a plurality of microchannels configured to flow refrigerant therethrough; and a distributor tube located at least partially within the inlet header, the distributor tube comprising a plurality of apertures, wherein each aperture is aligned with at least one corresponding microchannel of the plurality of microchannels, thereby permitting the refrigerant to flow through the at least one corresponding microchannel of the plurality of microchannels;

wherein the interlaced microchannel heat exchanger is fluidly coupled to a first compressor having a first size and a second compressor having a second size.

11. The interlaced microchannel heat exchanger of claim 10, wherein the interlaced microchannel heat exchanger is fluidly coupled to a first thermal expansion valve and a second thermal expansion valve.

12. The interlaced microchannel heat exchanger of claim 11, wherein the interlaced microchannel heat exchanger is fluidly coupled to a first reversing expansion valve and a second reversing expansion valve.

13. The interlaced microchannel heat exchanger of claim 10, wherein the interlaced microchannel heat exchanger is disposed in an indoor location.

14. The interlaced microchannel heat exchanger of claim 10, wherein the plurality of apertures of the distributor tube prevents the refrigerant from flowing through at least one of the plurality of microchannels.

15. The interlaced microchannel heat exchanger of claim 10, wherein the plurality of apertures of the distributor tube prevents the refrigerant from flowing through at least one of the plurality of heat exchanger tubes.

16. The interlaced microchannel heat exchanger of claim 10, wherein at least one of the plurality of apertures has a size that is approximately equal to a size of the at least one corresponding microchannel of the plurality of microchannels.

17. The interlaced microchannel heat exchanger of claim 10, wherein at least one of the plurality of apertures has a size that is smaller than a size of the at least one corresponding microchannel of the plurality of microchannels.

18. The interlaced microchannel heat exchanger of claim 10, wherein the plurality of apertures of the distributor tube comprises a first aperture having a first size that is smaller than a size of a microchannel of the plurality of microchannels, and a second aperture having a second size that is smaller than the first size.

19. The interlaced microchannel heat exchanger of claim 18, wherein the second size is smaller than the size of the microchannel of the plurality of microchannels.

* * * * *